US008557066B1

(12) United States Patent
Lee et al.

(10) Patent No.: US 8,557,066 B1
(45) Date of Patent: Oct. 15, 2013

(54) METHOD FOR FORMING ENERGETIC NANOPOWDERS

(75) Inventors: Kien-Yin Lee, Santa Fe, NM (US); Blaine W. Asay, Los Alamos, NM (US); James E. Kennedy, Santa Fe, NM (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 13/291,420

(22) Filed: Nov. 8, 2011

Related U.S. Application Data

(60) Continuation of application No. 12/941,144, filed on Nov. 8, 2010, now abandoned, which is a division of application No. 11/844,394, filed on Aug. 24, 2007, which is a division of application No. 11/072,536, filed on Mar. 7, 2005, now abandoned, and a continuation-in-part of application No. 10/890,845, filed on Jul. 12, 2004, now abandoned.

(51) Int. Cl.
*D03D 23/00* (2006.01)

(52) U.S. Cl.
USPC ..... 149/109.6

(58) Field of Classification Search
USPC ..... 149/109.6, 19.92
See application file for complete search history.

(56) References Cited

U.S. PATENT DOCUMENTS 3,728,086 A * 4/1973 Adicoff ..... 23/302 A
5,156,779 A * 10/1992 McGowan ..... 264/3.3
5,707,634 A * 1/1998 Schmitt ..... 424/400

FOREIGN PATENT DOCUMENTS

DE 4231377 A1 * 3/1994

* cited by examiner

*Primary Examiner* — Aileen B Felton
(74) *Attorney, Agent, or Firm* — Thomas S. O'Dwyer; James C. Durkis; John T. Lucas

(57) ABSTRACT

A method for the preparation of neat energetic powders, having nanometer dimensions, is described herein. For these neat powder, a solution of a chosen energetic material is prepared in an aprotic solvent and later combined with liquid hexane that is miscible with such solvent. The energetic material chosen is less soluble in the liquid hexane than in the aprotic solvent and the liquid hexane is cooled to a temperature that is below that of the solvent solution. In order to form a precipitate of said neat powders, the solvent solution is rapidly combined with the liquid hexane. When the resulting precipitate is collected, it may be dried and filtered to yield an energetic nanopowder material.

8 Claims, 2 Drawing Sheets

200nm

METHOD FOR FORMING ENERGETIC NANOPOWDERS

RELATED CASES

This application is a continuation of application Ser. No. 12/941,144 filed on Nov. 8, 2010 which is a divisional of co-pending patent application Ser. No. 11/844,394 filed on Aug. 24, 2007, the entire contents of which are hereby incorporated by reference. The latter co-pending application is a divisional of parent patent application Ser. No. 11/072,536 filed Mar. 7, 2005 and subsequently abandoned. The parent patent application is a continuation-in-part of nonprovisional patent application Ser. No. 10/890,845 filed Jul. 12, 2004 and subsequently abandoned.

STATEMENT REGARDING FEDERAL RIGHTS

This invention was made with government support under Contract No. W-7405-ENG-36 awarded by the U.S. Department of Energy to The Regents of the University of California. The government has certain rights in the invention.

FIELD OF THE INVENTION

The present invention relates generally to powdered materials and, more particularly, to the preparation of nanopowders, (powders having median particle dimensions of less than about 1 μm) of these materials and composites thereof also having submicron dimensions.

BACKGROUND OF THE INVENTION

The chemical explosive 3-nitro-1,2,4-triazol-5-one, more commonly known as NTO (see, U.S. Pat. No. 4,733,610 to Kien-Yin Lee et al. entitled "3-nitro-1,2,4-triazol-5-one, A Less Sensitive Explosive," which issued on Mar. 29, 1988, which is hereby incorporated by reference herein for all that it discloses and teaches) has the chemical formula:

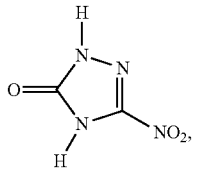

and can be prepared safely in high yield from inexpensive starting materials. It is a white crystalline compound, has a crystal density of 1.93 g/cm$^3$, is moderately soluble in water, relatively acidic ($pK_a$=3.67), and forms stable salts with mono- and bivalent metals, including potassium, sodium, lithium, magnesium, calcium, strontium, barium, manganese, iron, cobalt, nickel, copper, zinc, silver, and lead, and ammonium salts. It has found use as the gas generant for an azide-free formulation for inflatable vehicle safety device. See, for example, U.S. Pat. No. 6,123,790 for "Nonazide ammonium nitrate based gas generant compositions that burn at ambient pressure," which issued to Norman H. Lundstrom et al. on Sep. 26, 2000; and U.S. Pat. No. 6,296,724 for "Gas generating composition for an inflatable vehicle occupant protection device," which issued to Harold R. Blomquist on Oct. 2, 2001.

NTO has a calculated detonation velocity and detonation pressure (at crystal density) equivalent to that of RDX (cyclotrimethylenetrinitramine), and a low sensitivity to shock and impact. In fact, NTO is considered to be an insensitive high explosive (IHE), being less sensitive than RDX, TNT, and HMX (octahydro-1,3,5,7-tetranitro-1,3,5,7-tetrazocine) in all respects, and similar in sensitivity to TATB. See U.S. Pat. No. 6,547,899 for "Synthesis of Fine-Grained TATB," which issued to Kien-Yin Lee et al. on Apr. 15, 2003, and which is hereby incorporated by reference herein for all that it discloses and teaches.

For applications requiring both operational safety and high performance, it is desirable to have the design and formulation of an IHE, yet enable the tuning of performance and sensitivity.

Incorporation of aluminum nanopowders in energetic materials has been demonstrated to increase the burn rate of propellants, (See, for example: Fang Chong and Li Shufen, "Experimental Research Of The Effects Of Superfine Aluminum Powders On The Combustion Characteristics Of NEPE Propellants," Propellants, Explosives, Pyrotechnics 27, 34 (2002).), and improve the detonation performance of some high explosives (See, for example: H. E. Dorsett et al., "The Influence of Ultrafine Aluminum upon Explosives Detonation," 28$^{th}$ Int. Pyrotechnics Seminar, Adelaide, Australia, Nov. 4-9, (2001).). In "A Technique To Prepare Aluminized Nanosized Explosives," by A. N. Jigatch et al, 29$^{th}$ Int. Pyrotechnics Seminar, Westminster, Colo., USA, Jul. 14-19, 2002, the authors describe the preparation of HE-encapsulated aluminum using suspension atomization and drying. It is stated that mechanical mixing and pressing of micron-size explosive grains with aluminum nanopowders will not give a homogeneous distribution of aluminum particles in the pressed sample.

In the parent patent application, supra, the present inventors described the preparation of ultrafine NTO (UF-NTO) and its admixture with nanoAl powder by slow precipitation. The particle median of the UF-NTO was found to be greater than nanosize, and intimate mixing between NTO and nanoAl powder was not observed.

There remains a need for simple procedures for preparing homogeneous nanocomposites of high explosives with energetic inorganic nanoparticles having increased burn rate and improved detonation performance over known insensitive high explosive materials.

Accordingly, it is an object of the present invention to provide a method for preparing nanoparticles of materials.

Another object of the invention is to provide a method for preparing energetic nanopowders.

Yet another object of the invention is to provide a method for preparing nanocomposites of selected materials with nanoparticles.

Still another object of the present invention is to provide a method for preparing nanocomposites of energetic organic materials with energetic inorganic nanoparticles.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with its purposes of the present invention, as embodied and broadly described herein, the method for preparing powders having nanometer particle dimensions of a selected substance hereof includes: dissolving a chosen quantity of the selected substance in a first solvent therefor, thereby forming a solution; and rapidly combining the solution with a liquid miscible with the first solvent such that precipitation of the selected substance occurs.

In another aspect of the invention and in accordance with its objects and purposes, the method for preparing a composite of a selected substance with nanoparticles of a chosen additive material, wherein the resulting composite contains particles having nanometer dimensions, hereof includes: dissolving a chosen quantity of the selected substance in a first solvent therefor, thereby forming a solution; forming a suspension comprising the nanoparticles of the additive material in a liquid miscible with the first solvent; and rapidly combining the solution with the suspension such that precipitation of the selected substance occurs.

In yet another aspect of the invention and in accordance with its objects and purposes, the method for preparing a composite of a selected substance with nanoparticles of a chosen additive material, wherein the composite contains particles having nanometer dimensions, hereof, includes: dissolving a chosen quantity of the selected substance in a first solvent, thereby forming a solution; forming a suspension comprising the nanoparticles of the additive material in the solution; and rapidly combining the solution with a liquid miscible with the first solvent such that precipitation of the selected substance occurs.

In still another aspect of the present invention and in accordance with its objects and purposes, the composition of matter, hereof, includes a composite of a selected substance with nanoparticles of a chosen additive material, the composition of matter having particles with nanometer dimensions.

Benefits and advantages of the present invention include, but are not limited to, the rapid and simple preparation of neat powders and composites thereof having nanoparticle dimensions.

BRIEF DESCRIPTION OF THE DRAWINGS

The accompanying drawings, which are incorporated in and form a part of the specification, illustrate two embodiments of the present invention and, together with the description, serve to explain the principles of the invention. In the drawings.

DETAILED DESCRIPTION

Figure 1:
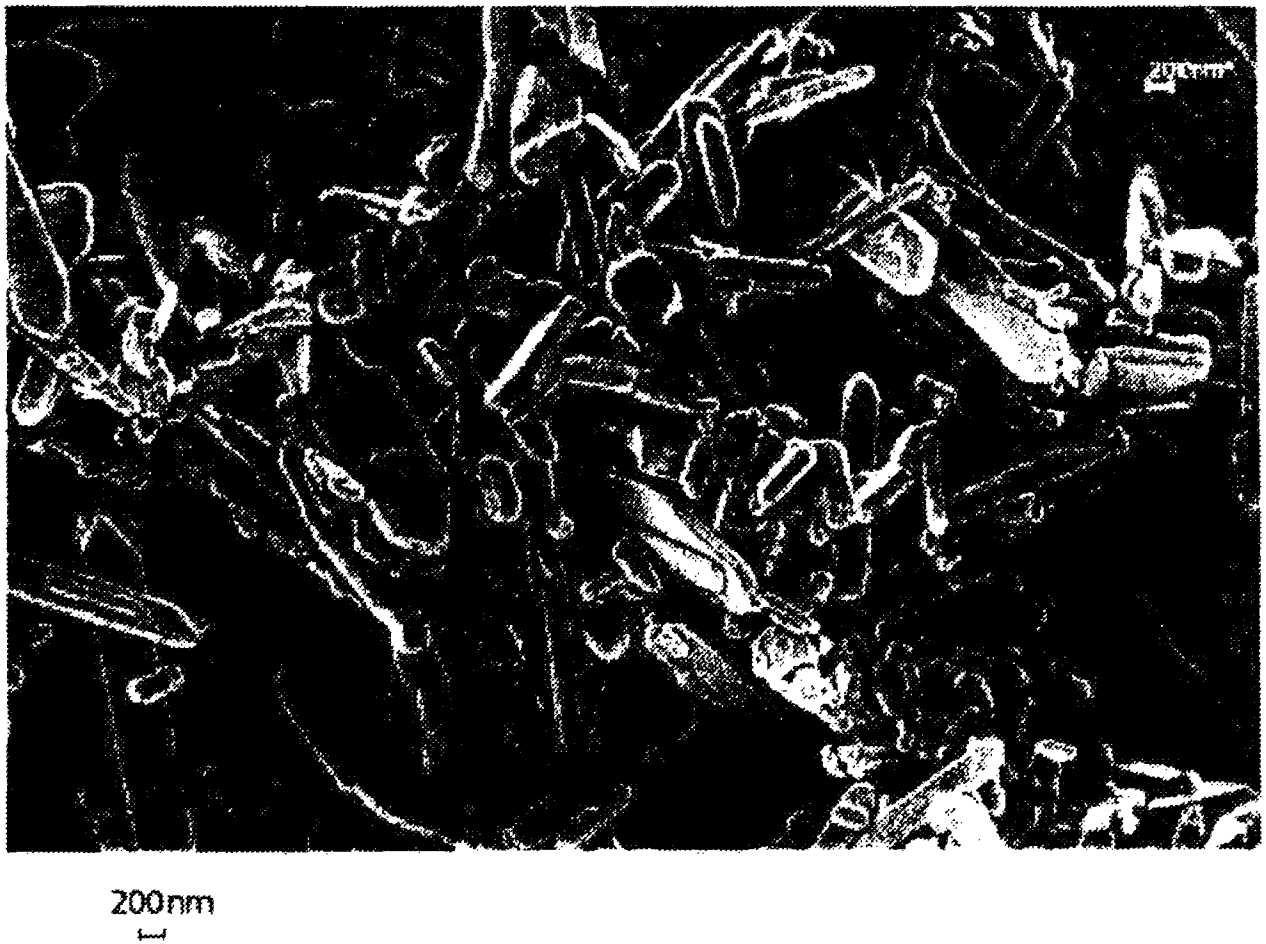
FIG. 1 is a scanning electron microscope image of an octahydro-1,3,5,7-tetranitro-1,3,5,7-tetrazocine (HMX) powder made in accordance with the teachings of the present invention.

Briefly, the present invention includes a method for preparing powders of selected materials having particles with nanometer dimensions and composites thereof also having nanometer dimensions. In the situation where 3-nitro-1,2,4-triazol-5-one (NTO) is mixed with aluminum, it is desired that the composites have increased interface area between Al and NTO particles, and that the aluminum be encapsulated by the NTO. As used herein, particles and composites having nanometer dimensions, nanoparticles and nanocomposites, respectively, means that the median particle size thereof is sub-micron (nanometer).

Reference will now be made in detail to the present preferred embodiments of the invention examples of which are illustrated in the accompanying FIGURES. The method for preparing powders of selected materials includes dissolving a chosen quantity of the selected material in a first solvent therefor, and rapidly combining the resulting solution with a liquid having a lower temperature than that of the first solvent, having lower solubility for the material than the first solvent therefor, and being miscible with the first solvent. As a result of the mixing process, a precipitate of the submicron particles of the material is formed.

The method for preparing intimately mixed composites having submicron-dimensioned particles, includes dissolving a first selected material in a first solvent therefor, and rapidly mixing the resulting solution with a suspension of a second selected material to be mixed with the first material in a liquid having a lower temperature than that of the first selected material, having a lower solubility for the first material than the first solvent therefor, and being miscible with the first solvent, either the first solvent or the chilled liquid containing a suspension of a second selected material. As a result of the mixing process, a composite precipitate having submicron particles is formed. Neither liquid should react with the second selected material.

As will be set forth in the EXAMPLES hereinbelow, the invention has been demonstrated using energetic materials such as NTO and nanoaluminum composites thereof, and with octahydro-1,3,5,7-tetranitro-1,3,5,7-tetrazocine (HMX); however, other systems may be contemplated. As an example, a solution of aluminum stearate in alcohol might be rapidly combined with a suspension of nanoparticles of alumina ($Al_2O_3$) suspended in water, producing thereby a nano-size-particle composite.

Moreover, in the situation where plastic bonded explosives (PBX) are desired and, more particularly PBX-aluminized NTO, as an example, binder-formulated Al nanopowders may be used in place of nanoAl powder in the practice of the present invention. Clearly, other metals, such as nanoparticles of tungsten, as an example, may be used in accordance with the teachings of the present invention, and the properties of the nanocomposites prepared may depend on the type and properties of the additive powder or powders used. For example, nanocomposites generated using agglomerated aluminum powder may behave differently than nanocomposites using discrete aluminum particles, since the contact surface area of the particles in the composite would be different.

Concerning the miscibility of the chilled liquid with the first solvent, it is believed by the present inventors, that nanoparticles of the selected material may be generated if the chilled liquid is employed to rapidly cool a saturated or substantially saturated solution of the selected material in the first solvent therefor. Therefore, the miscibility requirement may be relaxed.

Having generally described the invention, the following EXAMPLES provide more specific details. The preparation of nanoparticle HMX powder using a rapid precipitation process is described, as are the preparations of various weight percent formulations of NTO with metal (aluminum, as an example).

Example 1

Preparation of Nanosized HMX:

About 300 ml of hexane was chilled to about 0° C. in a jacketed, 1 liter, 3-neck, round-bottom flask having an overhead stirrer, a drying tube and an addition funnel. A solution of coarse HMX (1.58 g, $5\times10^{-3}$ mole) in about 75 ml of acetone was quickly poured into the cold, vigorously stirring hexane through the addition funnel. The mixture was vigorously stirred for an additional 10 min. at 0° C. The resulting product was collected by filtration, and dried in a vacuum oven for approximately 2 h at about 40° C., giving an approximately 90% yield of product. FIG. 1 is a scanning electron microscope image of HMX powder made in accordance with the teachings of the present invention.

Example 2

Preparation of Aluminized NTO Composite: Nanosized NTO/Nanosized Al Ratio of about 85/15 wt %:

About (300 ml) of hexane was chilled to about 0° C. in a 1 liter, jacketed, 3-neck, round-bottom flask equipped with an overhead stirrer, a drying tube and an addition funnel. A solution of NTO (2.62 g, $2\times10^{-2}$ moles) in about 50 ml of tetrahydrofuran (THF) with approximately 0.42 g Al suspended nanopowder (40-nm median particle size, from Technanogy, Inc., having a surface area of 49.4 $m^2/g$ with 68.7 wt Al and 1.7-nm-thick oxide) was also prepared. To achieve better dispersion of the Al in the NTO solution, the suspension was sonicated for about 5 min. in an ultrasonic bath (Branson 2210), and quickly poured into the vigorously stirring, cold hexane. The vigorous stirring was continued for an additional 10 min., during which time the mixture was kept at about 0° C. The mixture was then filtered, and the resulting aluminized NTO composite was dried in a vacuum oven for several hours at about 40° C., giving an approximately 90% yield of product. It should be mentioned that the aluminum nanopowder may be suspended in the hexane, with similar results expected. It should be mentioned the stirring was performed using an overhead stirrer when aluminum was used as the additive particles, because it was found that the aluminum nanoparticles attached themselves to magnetic stirrers.

Figure 2:
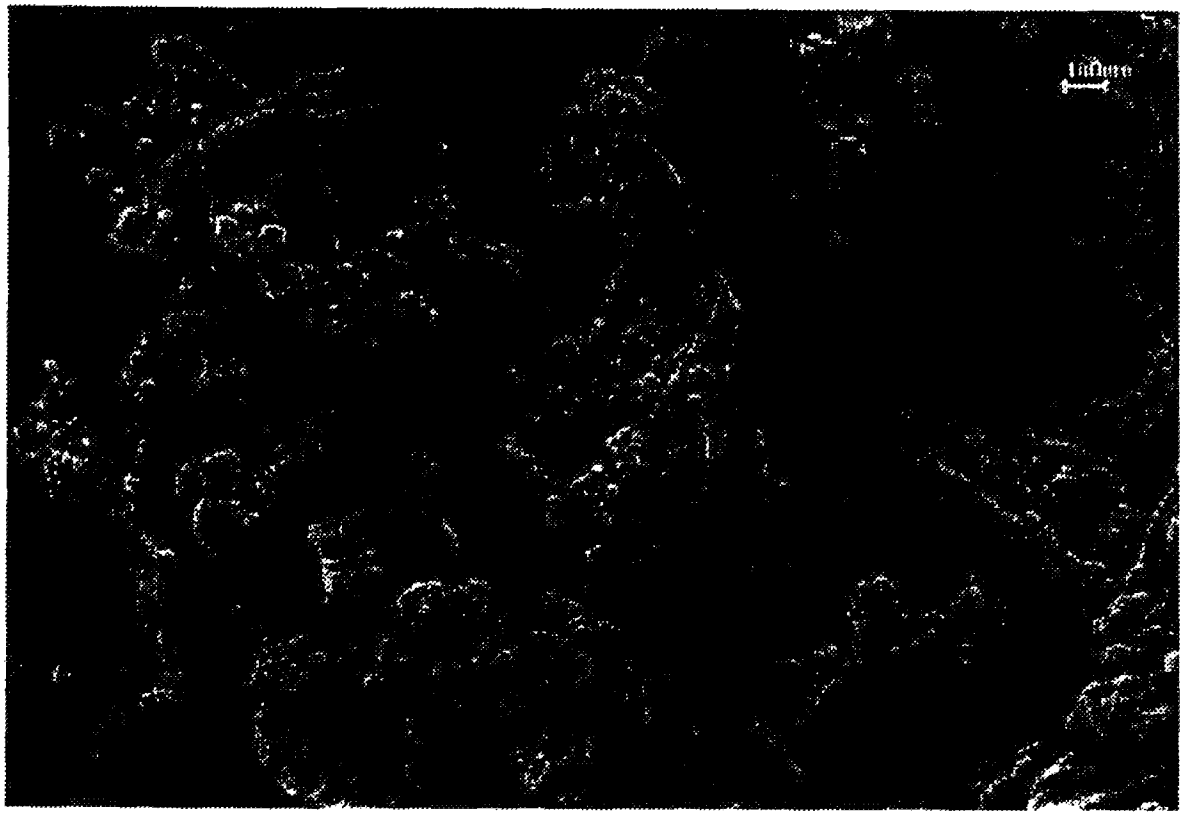
FIG. 2 is a scanning electron microscope image of an NTO/nanoaluminum composite (90/10 wt %) made in accordance with the teachings of the present invention.

FIG. 2 is a scanning electron microscope image of an NTO/nanoaluminum composite (90/10 wt %) made in accordance with the teachings of the present invention. It is expected that up to 30 wt % of the nanocomposite may be aluminum.

Nanoparticle NTO was prepared by a similar method, as a control composition. Moisture was kept to a minimum in order to minimize the oxidation of aluminum during the preparation.

Samples of (submicron) sm-NTO and its intimate mixture with Al in a 90/10 wt % ratio were subjected to small-scale sensitivity tests, Henkin critical temperature tests, scanning electron microscopy, and Floret tests.

1. Small-Scale Standard Sensitivity Tests:

A total of three tests were performed, and the results from these tests indicated that the NTO/AI mix behaves similarly to neat NTO and is insensitive to impact, friction and human electrostatic discharge (HESD) sensitivities. Representative small-scale sensitivity test data for sm-NTO and its formulation with nano-Al powder are summarized in TABLE 1. For comparison, the sensitivity data for the 40 nm Al powder are also listed.

TABLE 1

| Sample | Impact Sensitivity $h_{50}$ (cm) (type 12a) | Friction Sensitivity (kg) | Spark Sensitivity (HESD) @ 0.36 J |
|---|---|---|---|
| Sm-NTO | >320 | >36 | >0.36 |
| sm-NTO/Al Mix (90/10 wt % Al) | 157 | >36 | >0.36 |
| 40 nm Al powder | >320 | >36 | >0.36 |

2. Henkin Critical Temperature Test

Samples of NTO and aluminized NTO composite (90/10 wt %) were characterized for their critical temperatures (Tm) using the modified Henkin test. The critical temperature is defined as the lowest temperature at which a sample of energetic material of known geometry will self-heat to explosion. The test apparatus is a heated vessel that contained molten (~200° C.-400° C.) Wood's metal for which the temperature may be controlled. A small quantity of energetic material (<1 g) was pressed into an aluminum casing and placed in the molten metal. TABLE 2 illustrates the critical temperatures for both NTO and NTO/AI mix. It may be observed that the critical temperature of the aluminized NTO mix is 5.5° C. lower than that of neat NTO.

TABLE 2

| Samples | Critical Temperature (Tm) (° C.) | Slab Geometry Thickness (mm) |
|---|---|---|
| 1. NTO | 243.3 | 0.77 |
| 2. NTO/Al Mix (90/10 wt %) | 237.8 | 0.84 |

3. Surface Structure by Scanning Electron Microscopy:

Samples of both sm-NTO and its formulation with nano-Al powder were examined using a LEO 1525 Scanning Electron Microscope. As shown in FIG. 2 hereof, the average particle size of NTO in the aluminized NTO mix obtained by the precipitation method of the present invention is about 300 nm, and the nanoaluminum particles appear to be fused into the NTO matrix.

4. Floret Tests:

The floret test (called the detonation-spreading, spot-size test in "Detonation Spreading in Fine TATBs" by J. E. Kennedy et al., Proceedings, 24$^{th}$ International Pyrotechnics Seminar, Monterey, Calif., July, 1998, IIT Research Institute, pp. 743-748) is a means for ranking the detonation spreading of an energetic material using a small quantity of the material. See also, "Synthesis, Detonation Spreading And Reaction Rate Modeling of Fine TATB" by Kien-Yin Lee et al., 11$^{th}$ International Detonation Symposium, Aug. 31 through Sep. 4, 1998, Snowmass Village, Colo. 81615, pp. 362, released in August 2000, and the parent patent application, supra.

Samples of sm-NTO, UF-NTO (Note that the neat UF-NTO was prepared in accordance with the teachings of the parent patent application, supra, where the average NTO particle size is less than 5 microns.), and aluminized NTO composition (85/15 wt %) were pressed into pellets having indicated densities for testing. Dent depth results from floret tests shown in TABLE 3 using 4-mm-diameter flyer plates indicate that nanocomposites produced shallower dents in the copper plate than those produced using neat NTO which may indicate that the NTO/AI may not have completely detonated. It is also believed by the present inventors that the deeper dent from sm-NTO, when compared with that for UF-NTO may indicate that the UF-NTO detonation may be non-ideal at small scale.

TABLE 3

| Sample | Density (g/cc) | DENT DEPTH (in.) |
|---|---|---|
| sm-NTO | 1.682 | 0.078 |
| | 1.692 | 0.079 |
| | 1.700 | 0.084 |
| sm-NTO/Al Mix | 1.686 | 0.043 |
| (85/15 wt % Al) | 1.694 | 0.043 |
| | 1.699 | 0.043 |
| Neat UF-NTO | 1.69 | 0.067 |

In summary, it was found that similar to neat NTO, the aluminized NTO composite are insensitive to friction and human electrostatic discharge (HESD). To characterize the decomposition reaction of the aluminized NTO mix, modified Henkin test was performed. Results from this test indicated that the critical temperature ($T_m$) of the aluminized-NTO composite is slightly lower than that of neat NTO, yet both are higher than 200° C. The solvent system may be tuned to prepare composites having a wide range of additive material content.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for forming an energetic powder material, said powder having particles with nanometer dimensions, comprising:

dissolving a predetermined quantity of selected energetic material in an aprotic organic solvent, thereby forming a solution;

rapidly combining said solvent solution with liquid hexane, wherein the liquid hexane has been cooled to a temperature that is below that of said solvent solution;

precipitating particles of selected energetic material;

collecting the nanoparticles of said precipitate; and drying the collected particles of said energetic material.

2. The method for forming the powder material of claim 1, wherein the energetic material is an organic compound.

3. The method of forming the powder material of claim 2, wherein the organic compound comprises 3-nitro-1,2,4-triazol-5-one (NTO) and the organic solvent comprises tetrahydrofuran.

4. The method of forming the powder material of claim 2, wherein the organic compound comprises octahydro-1,3,5,7-tetranitro-1,3,5,7-tetrazocine (HMX) and the organic solvent comprises acetone.

5. The method for forming the powder material of claim 1, wherein the step of rapidly combining said solvent solution with said liquid hexane occurs by vigorously stirring the mixture.

6. The method for forming the powder material of claim 1, wherein the step of collecting the energetic particles occurs by filtration.

7. The method for forming the powder material of claim 1, wherein the step of drying the energetic particles occurs in a vacuum oven.

8. The method for forming the powder material of claim 1, wherein said liquid hexane has been cooled to a temperature of about 0° C.

* * * * *